United States Patent [19]

Goodine

[11] 4,366,802

[45] Jan. 4, 1983

[54] SAWDUST AND WOOD CHIP BURNER

[76] Inventor: Herbert M. Goodine, R.R. No. 2, Arthurette, New Brunswick, Canada

[21] Appl. No.: 317,180

[22] Filed: Nov. 2, 1981

[30] Foreign Application Priority Data

Feb. 17, 1981 [CA] Canada ..... 371058

[51] Int. Cl.[3] ..... F24H 3/02; F24B 7/00

[52] U.S. Cl. ..... 126/110 R; 126/121; 110/108; 110/116; 110/118

[58] Field of Search ..... 126/110, 106, 109, 104, 126/112, 121; 110/248, 186, 108, 116, 118

[56] References Cited

U.S. PATENT DOCUMENTS

| | | | |
|---|---|---|---|
| 1,944,488 | 1/1934 | Bertossa | 126/109 |
| 3,171,400 | 3/1965 | Heiman | 126/110 R |
| 3,889,653 | 6/1975 | Scogin | 126/110 R |
| 4,201,187 | 5/1980 | Skow | 126/109 |
| 4,230,268 | 10/1980 | Gorman et al. | 126/110 R |
| 4,325,310 | 4/1982 | Babbage | 110/116 |

*Primary Examiner*—Henry C. Yuen

*Attorney, Agent, or Firm*—Eric P. Schellin

[57] ABSTRACT

A sawdust and chip burner for use with an existing furnace for heating water or a forced air system. The burner overcomes a previously known deficiency in prior burners in overcoming burn-back, the latter meaning creeping of combustion back into the stored fuel. The burn-back hazard is overcome in the present invention by the provision of double-walling of the fuel hopper adjacent the exit thereof and the supplying of cooling air through the passage formed by the double walling. In addition to preventing burn-back, the cooling air exits at a higher temperature and the thus heated air may be used to augment the heat output from the burner.

9 Claims, 3 Drawing Figures

SAWDUST AND WOOD CHIP BURNER

This invention relates to sawdust burners although it is to be understood that other granular or particulate fuels may be used. Further, the invention has particular utility when used in conjunction with an existing forced air or circulated water types of furnace.

Prior known sawdust burners are typified by Canadian Pat. Nos. 238,031, Feb. 28, 1924, Jouclard; 299,665, Feb. 14, 1928, Martin; 315,161, Sept. 15, 1937, Groedel; 403,779, June 28, 1934, Horton; 416,659, Nov. 30, 1943, Knightall and 502,792, May 18, 1954, Cairnes et al. Also an article "Rating and Care of Domestic Sawdust Burners" published by Engineering Experiment Station, Oregon State System of High Education, Oregon State College, Bulletin Series, No. 15, June, 1941.

The above listed prior art discloses various burners of the general type. However, in all such examples, there exists the common hazard of burn-back. When a feeding hopper is anything up to half-full, the lower portion of the stored sawdust is in close contact with the hopper walls. Even when the draught door or doors is or are closed the stored sawdust can be charred or ignited by contact with the hopper walls. If then the draught doors are opened and heated sawdust can ignite with hazardous consequences.

It is a feature of one object of the invention to provide convected or forced cooling air through a space formed between double walled hoppers in a sawdust burner.

It is a feature of another object of the invention to utilize the air heated in the foregoing feature to augment the heat provided in the main heating elements.

It is a feature of another object of the invention to provide a sawdust and chip burner that is sufficiently air tight to enable the burner to be closed down to a very low burning rate.

It is a feature of another object of the invention to provide a sawdust and chip burner that can be used both separately or in conjunction with an existing furnace.

It is a primary feature of another object of the invention to provide a sawdust and chip burner having a double walled hopper which is cooled by the passage of cooling air through the space formed by the double wall.

A preferred embodiment of the invention will now be described with reference to the accompanying drawings, in which.

Figure 1:
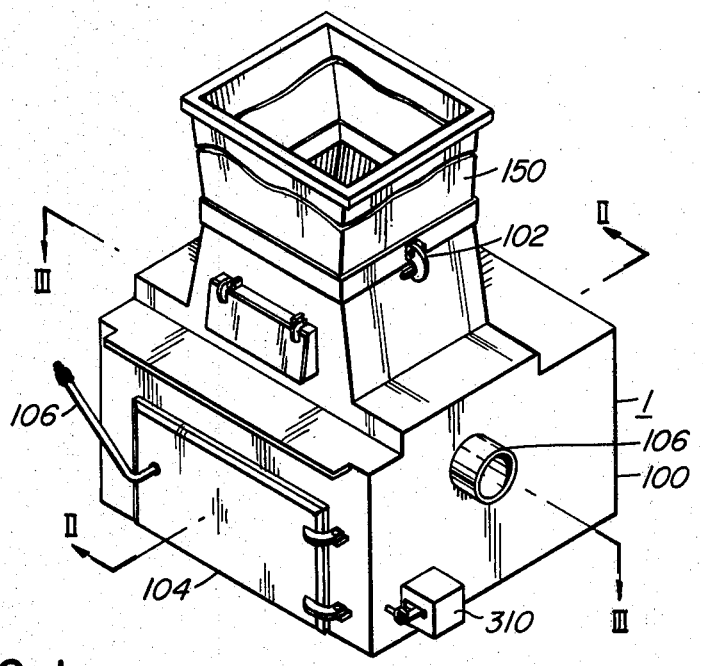
FIG. 1 is an isometric view of the sawdust burner.

Referring now to FIG. 1, the sawdust burner body generally indicated at 1, comprises a firebox 100 and a separable hopper 150 which may be clamped together as by clamp 102. An air-tight grate access door 104 is hinged to the body 1 and may be locked closed as by handle 108. Cooling air enters at an entrance 107 and leaves via an exit 106 to be described hereinafter.

Figure 2:
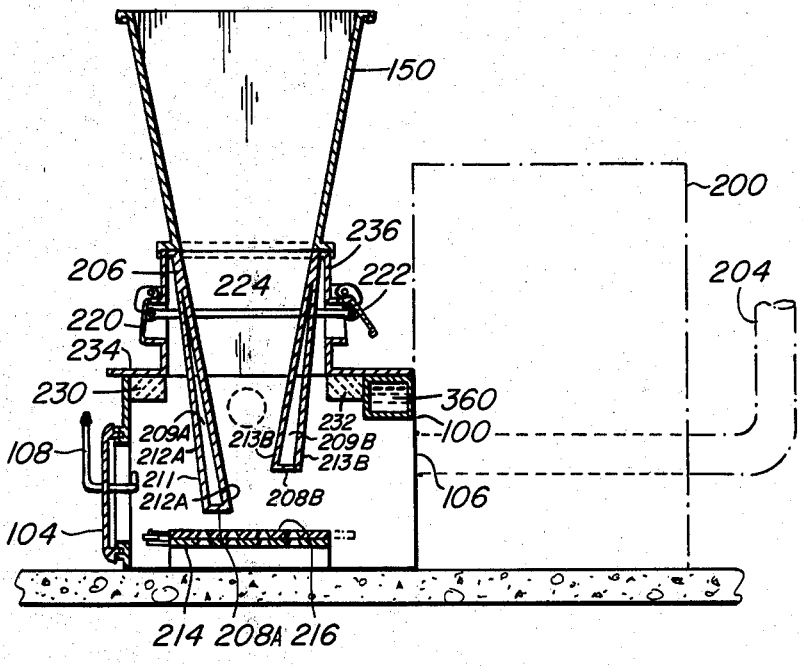
FIG. 2 is a side view, partly in section, along the line II—II in FIG. 1 of the sawdust burner shown in FIG. 1.

Referring to FIG. 2, there is provided a hopper support member 236 from which extends downwardly a lower convergent hopper extension 206 having a front wall 212A terminating at end 208A and a rear wall 212B terminating at end 208B. The entire hopper assembly, in use, is initially filled with sawdust or wood chips which self-feed gravitationally. A grate comprising a fixed burner perforated grate member 214 and an upper perforated grate member 216. The upper grate member 216 is slidable in relation to the lower grate 214 in response to an electrical linear actuator 310 coupled thereto by a rod 312 (see FIG. 3). During use, ash falls through the perforations in each of grate members. The lower front end 208A of the hopper extension 206 is spaced upwardly and away from the upper grate member 126 by a relatively small distance.

The lower back end 208B is spaced upwardly and away from the upper grate member 126 by a relatively larger distance. This latter distance provides space for the location of a burning region for the fuel. Air for combustion enters at front door 220 and/or a rear door 222. If back doors are provided, a common link rod 224 may be connected therebetween whereby one door may be closed upon opening of the other door. The linkage system, however, includes means, not shown, for closing or opening both doors separately or together. Such door operation may be controlled thermostatically.

Figure 3:
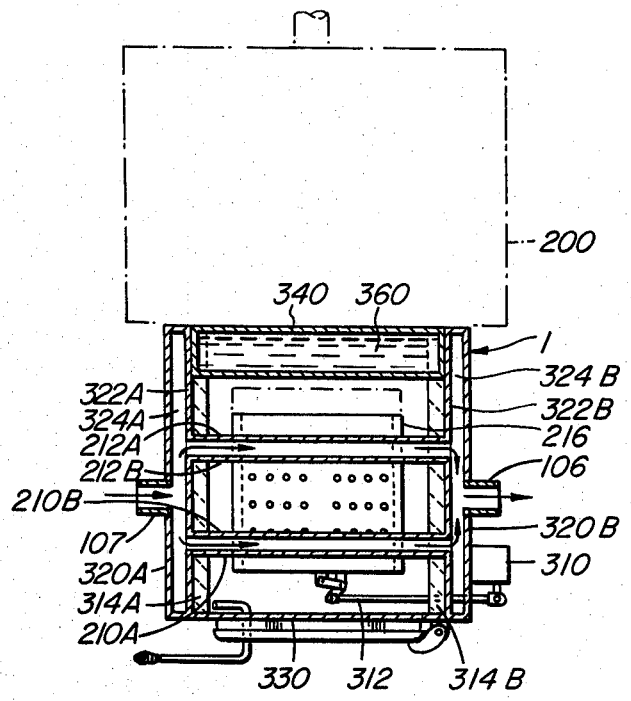
FIG. 3 is a plan section along the line III—III in FIGS. 1 and 2.

Referring to FIG. 3, the burner includes front and back outer walls 330 and 340 and outer walls 320A and 320B and a top member 234. Further, there are provided end inner walls 322A and 322B. A secondary air inlet 107 communicates with the space 324A formed between inner and outer end walls 320A and 322B. Similarly, an outlet 107 communicates with the space 324B formed between inner and outer end walls 322B and 320B.

Referring to FIG. 2, the lower extension of the hopper formed by front and back members 211A and 213, comprises an outer front wall 212A and an inner front wall 212B and an inner back wall 312B and an outer back wall 213A, thereby defining front and rear cooling ducts 209A and 209B. These cooling ducts are connected to and provide cooling air flow between spaces 324A and 324B (see FIG. 2). This air flow, in the direction indicated by arrows, cools the lower extension of the hopper and has been found to substantially eliminate burn-back of the fuel. If the outlet 106 is left open heated air may be used to heat a basement or may be passed into the cold air return duct of a conventional forced air furnace system or to the hot air side of such a system providing the blower has sufficient pressure to maintain the passage of cooling air against the air pressure existent in the hot air duct of the conventional furnace. A water heating tank 360 may be disposed across the back of the burner and inlet and outlet pipes (not shown) provided for directing cold water into and hot water out of the tank. The tank is in a heat radiation receptive location. The end walls 322A and 322B may be lined with fire-brick as at 314A and 314B. Similarly, the transverse fire-brick members may be located at 230 and 232 as seen in FIG. 2.

The grate actuator 310 may be periodically energized by means of a conventional electrical timer. The periodicity can be varied from a few minutes up to several hours dependent on the type of fuel being burned and the desired rate of burning as determined by the adjustment of the doors 220 and 222. The flow of combustion air is controlled by a thermostat and the movement of the upper grate can be controlled by a timing device in conventional manner. It will be observed that combustion air may flow both over and under the grates 214 and 216.

The hopper has been found to permit twelve to fifteen hours of combustion with one filling. An automatic feeder, not shown, will enable up to four days of continuous combustion. It is recommended that the hopper be covered during combustion of the fuel. This improves safety when the level of fuel is burning low. Such cover will also prevent leakage of excessive air to the combustion region when the level of fuel is low.

The entire burner can be formed of cast iron or fabricated from steel plate or a combination thereof excepting, of course, the items formed of fire brick.

The base of the burner body 1 may be constituted by the concrete floor upon the burner stands. However, a steel base, joining the side, front and rear walls, may be included.

While the preferred embodiment of the invention has been described with reference to the provision of cooling ducts within the front and rear hopper members, it is to be understood that the corresponding side members of the hopper may be similarly cooled.

Other embodiments of the invention, falling within the limits of the appended claims, will occur to those skilled in the art.

I claim:

1. A burner for use with sawdust, wood chips or other particulate fuel, comprising:

(i) a front wall, including a door which is substantially air-tight when closed, (ii) a rear wall having an aperture therein from which combustion gases may exit from the burner, (iii) a first side outer wall including a cold air entry aperture, (iv) a first side inside wall spaced inwardly from said first side outer wall, to form a first space, (v) a second side outer wall including a hot air exit aperture, (vi) a second side inner wall spaced inwardly from said second side outer wall to form a second space, (vii) a top member joined to said front, rear and outer walls, (viii) a hopper support extending upwardly from said top member, said hopper support including at least one combustion air intake with air flow adjustment means thereon, and, (ix) front and rear hopper members fastened to the said hopper support members and extending downwardly therefrom, said front and rear hopper members converging towards each other at the lower ends thereof to provide a space therebetween from which fuel may fall into a combustion region, both said front and rear hopper members being hollow and each extend between and is fastened to said fist side inner wall and said second side inner wall each of which includes apertures corresponding to the space defined by the respective hollow front and rear hopper members, whereby air flow between said first and second spaces is safely through said hollow hopper members.

2. A burner as defined in claim 1 further including a first fixed grate member and a second movable grate member mounted for sliding cooperation with said first grate member, both said grate members having apertures therein through which ash may pass.

3. A burner as defined in claim 2 further including automatic means for periodically moving said movable grate member.

4. A burner as defined in claim 1 further including fire brickwork on at least the underside of a portion of said top member.

5. A burner as defined in claim 1 further including fire brickwork on at least the interior surfaces of said inner side walls.

6. A burner as in claim 1 wherein said combustion air intake air flow adjustment means is provided with a thermostatic element.

7. A burner as in claim 1 further including a water heating tank disposed in a radiation receptive location adjacent said combustion region.

8. A burner as in claim 1 further including blower means for forcing relatively cool air into said first space, through said hollow hopper members, into said second space and out through said hot air exit aperture.

9. A burner as in claim 1 wherein said door is hinged to said front wall and further includes a clamp member for selectively holding said door in substantially air tight cooperation with said front wall.

* * * * *